US007422009B2

(12) United States Patent
Rummel et al.

(10) Patent No.: US 7,422,009 B2
(45) **Date of Patent: *Sep. 9, 2008**

(54) GAS "TRUE" CONVECTION BAKE OVEN

(75) Inventors: Randy L. Rummel, Huntington Beach, CA (US); Eric H. Y. Deng, Irvine, CA (US)

(73) Assignee: Dynamic Cooking Systems, Inc., Huntington Beach, CA (US)

( * ) Notice: Subject to any disclaimer, the term of this patent is extended or adjusted under 35 U.S.C. 154(b) by 223 days.

This patent is subject to a terminal disclaimer.

(21) Appl. No.: 10/824,766

(22) Filed: Apr. 13, 2004

(65) Prior Publication Data

US 2006/0130824 A1 Jun. 22, 2006

Related U.S. Application Data

(63) Continuation of application No. 10/060,966, filed on Jan. 29, 2002, now Pat. No. 6,718,965.

(51) Int. Cl.
*F24C 15/32* (2006.01)
*A21B 1/00* (2006.01)

(52) U.S. Cl. ..... 126/21 A; 126/21 R; 432/176

(58) Field of Classification Search ..... 126/21 A, 126/21 R, 273 R, 39 D; 432/176, 199
See application file for complete search history.

(56) References Cited

U.S. PATENT DOCUMENTS

| | | | |
|---|---|---|---|
| 3,155,814 | A | 11/1964 | Appleman et al. |
| 3,313,917 | A | 4/1967 | Ditzler et al. |
| 4,108,139 | A | 8/1978 | Gilliom et al. |
| 4,366,177 | A | 12/1982 | Wells et al. |
| 4,395,233 | A | 7/1983 | Smith et al. |
| 4,426,570 | A | 1/1984 | Hikino et al. |
| 4,516,012 | A | 5/1985 | Smith et al. |
| 4,648,377 | A | 3/1987 | Van Camp |
| 4,781,169 | A | 11/1988 | Henke et al. |

(Continued)

FOREIGN PATENT DOCUMENTS

| | | |
|---|---|---|
| JP | 58136921 | 8/1983 |

(Continued)

*Primary Examiner*—Alfred Basichas
(74) *Attorney, Agent, or Firm*—Knobbe, Martens, Olson & Bear, LLP

(57) ABSTRACT

Disclosed is a convection oven capable of producing a "true" convection cooking environment with a single gas burner disposed underneath the oven bottom in a combustion box. A fan compartment is disposed substantially at the center of the back wall, and defined by a baffle plate with a central fan inlet, a plurality of rearward-extending flanges, and a portion of the oven back wall. A centrifugal fan is disposed within the fan compartment. A flue spout is disposed between the oven cavity and the fan compartment and is adapted to join the combustion box and the oven cavity in fluid communication. Thus the centrifugal fan, located substantially centrally within the fan compartment will draw hot air and flue products upward from the combustion box, through the flue spout, through the central fan inlet, and blow the hot air and flue products into the oven cavity through peripheral fan outlets formed in the fan compartment. The oven may alternatively be operated in a fan-off mode, thus allowing the oven cavity to be heated by the upward flow of air due to natural convection.

40 Claims, 4 Drawing Sheets

U.S. PATENT DOCUMENTS

| | | | | |
|---|---|---|---|---|
| 4,802,459 | A | 2/1989 | McFadden et al. | |
| 4,881,519 | A | 11/1989 | Henke | |
| 4,930,489 | A | 6/1990 | McFadden | |
| 4,951,648 | A | 8/1990 | Shulka et al. | |
| 5,080,087 | A | 1/1992 | McFadden et al. | |
| 5,497,760 | A | 3/1996 | Alden et al. | |
| 5,601,070 | A | 2/1997 | Hotard et al. | |
| 6,038,964 | A | 3/2000 | Sikes | |
| 6,143,341 | A | 11/2000 | Sikes | |
| 6,718,965 | B2 * | 4/2004 | Rummel et al. | 126/21 A |

FOREIGN PATENT DOCUMENTS

| | | |
|---|---|---|
| JP | 59052134 | 3/1984 |
| JP | 60155832 | 8/1985 |

* cited by examiner

GAS "TRUE" CONVECTION BAKE OVEN

CROSS REFERENCE TO RELATED APPLICATIONS

This is a continuation of U.S. patent application Ser. No. 10/060,966, filed Jan. 29, 2002, now U.S. Pat. No. 6,718,965, which is incorporated herein by reference in its entirety.

BACKGROUND

1. Field of the Invention

The invention relates in general to the field of food preparation ovens, and specifically to a gas "true" convection oven.

2. Description of the Related Art

Convection ovens have long been popular in the cooking industry for both residential and commercial use. Typically, a gas convection oven involves a heat source disposed underneath the oven cavity, and a fan within the cooking cavity to circulate the hot air in the cooking cavity. This arrangement has the disadvantage that the air being blown through the fan is only as hot as the air within the oven cavity. Thus the heating of the food in the oven is uneven and much of the heat from the heat source is lost.

In order to improve the heating efficiency and increase oven temperatures, it was contemplated to provide a heat source in close proximity to the fan such that the air being moved by the fan is hotter than the air within the oven cavity. Thus food products within the oven are heated uniformly by air of a higher temperature, thus increasing heat transfer efficiency between the air and food products and reducing cooking times. This arrangement is typically termed "true convection" in the cooking appliance industry. Essentially, the term "true convection" refers to an oven in which a burner, or heat source is disposed in close proximity to the fan and that the air passing through the fan and into the oven cavity is at a higher temperature than the air within the oven, thus the heat is convectively transferred from the hot, moving air to the food products within the oven.

Such "true" convection environments are typically created with an electric heat source disposed immediately in front of, behind, or surrounding the convection fan. This convection heat source is typically provided in addition to heat sources for standard non-convective baking. This has the result of significantly increasing the cost of the oven due to the fact that the oven must be adapted to operate multiple heat sources of various type and size. When the standard heat source is a gas burner or broiler, the oven must be adapted to operate with both gas and electrical power. Additionally, it is difficult to install a gas burner in close proximity to the fan, as the turbulence caused by the fan will greatly affect flame stability and emission. It has also been difficult to design a gas burner which can function in both fan-on and fan-off conditions.

It is therefore desirable to create a gas "true convection" cooking environment in an oven without the necessity of multiple heat sources, while providing the ability to draw hot air from a heating source with stable combustion conditions.

SUMMARY

Therefore an oven is described herein which is capable of producing a "true convection" environment with a single gas burner disposed underneath the oven bottom in a combustion box, and a flue spout disposed at the rear of the oven and attached to a fan to draw hot air and flue products directly from the burner within the combustion box and blow them into the oven cavity.

Thus, one embodiment of an oven having preferred features and advantages includes an oven comprising an oven cavity defined by a plurality of side walls, a bottom wall, a top wall, a back wall, and a door. A fan compartment is disposed substantially centrally on the back wall, and is defined by a baffle plate spaced forwardly from the back wall, a plurality of rearward-extending flanges, and a portion of the back wall. A centrifugal fan is preferably disposed within the fan compartment, and the baffle plate preferably has a central fan-inlet portion. A combustion box having a front wall, a rear wall, a plurality of side walls and a bottom wall is preferably mounted to an underside of the oven bottom. A tube-type gas burner having a longitudinal axis perpendicular to the oven side walls is preferably disposed in a forward portion of the combustion box. A flue spout is preferably disposed between the baffle plate and the oven cavity, and is preferably adapted to join the fan compartment and the combustion box in fluid communication.

The baffle plate preferably comprises peripheral outlets. In one preferred embodiment, the combustion box bottom comprises a rearward, upward slope, the front side of the combustion box comprises a plurality of primary air inlet holes, and the bottom of the combustion box preferably comprises a plurality of secondary air inlet holes. The oven may include exhaust vents located substantially near the bottom of the back wall. Openings may be formed in the oven bottom to provide direct fluid communication between the oven cavity and the combustion box. In one embodiment, the flue spout comprises an upper portion which covers substantially the entire fan inlet. Alternatively, in another embodiment, the flue spout upper portion covers substantially half of the fan inlet portion of the baffle plate. The fan compartment may also comprise an opening in its top or other flange.

Another embodiment of an oven having preferred features and advantages includes an oven cavity defined by two upright side walls, a bottom, a top, a back wall, and a door, the bottom having openings joining the oven cavity and the combustion box in fluid communication. A baffle plate having a central fan inlet portion and peripheral fan outlet portions preferably forms the front of a fan compartment disposed substantially at the center of the back wall. The fan compartment is preferably defined by the baffle plate, a plurality of rearward-extending flanges, and a portion of the back wall. A centrifugal fan is disposed within the fan compartment. A combustion box having a front wall, a rear wall, a plurality of side walls and a bottom is preferably mounted substantially centrally to an underside of the oven bottom. A flue spout with a solid front wall is preferably disposed between the baffle plate and the oven cavity, and preferably joins the fan compartment and the combustion box in fluid communication. According to this embodiment, the fan inlet is preferably substantially entirely covered by the flue spout. A tube-type gas burner having a longitudinal axis perpendicular to the oven side walls, is disposed in the front of the combustion box.

Additionally, the combustion box bottom may comprise a rearward, upward slope, the front side of the combustion box may comprise a plurality of primary air inlet holes, and/or the bottom of the combustion box may comprise a plurality of primary air inlet holes. The combustion box bottom may additionally comprise a plurality of secondary air inlet holes. The oven may include exhaust vents located substantially near the bottom of the back wall. The oven top preferably does not have a fan compartment attached thereto. The fan compartment may also comprise an opening in its top or other flange.

According to another preferred embodiment, an oven having desired features and advantages may include an oven cavity defined by a plurality of walls, a bottom, a top wall, a back wall, and a door; a combustion box having a plurality of upright walls and a bottom wall, the box being mounted to an underside of the oven bottom; the oven bottom having openings joining the oven cavity and the combustion box in fluid communication; a baffle plate having a central fan inlet and peripheral fan outlets; a fan compartment disposed substantially centrally on the back wall, and defined by the baffle plate, a plurality of rearward-extending flanges, and a portion of the back wall; a centrifugal fan disposed within the fan compartment; a tube-type gas burner disposed substantially near and parallel to the front wall of the combustion box; and a flue spout having a front wall, a top wall, a plurality of rearward-extending sides, and a lower inlet portion, the inlet portion being substantially wider than the top wall, the flue spout being disposed between the baffle plate and the oven cavity such that the inlet portion extends into the combustion box, and the flue spout covers a portion of the fan inlet Such that the flue spout is placed in fluid communication with the fan compartment.

Additionally, according to this embodiment, the fan inlet may be substantially entirely covered by the flue spout, and the flue spout may be adapted to allow only heated air from the combustion box to enter the fan inlet. Exhaust vents are preferably located substantially near the bottom of the back wall.

According to still another embodiment, a method of convectively cooking a food product comprises the steps of providing an oven having a cooking space, a combustion box disposed below the cooking space, a fan compartment disposed at the rear of the cooking space, and providing a flue spout disposed to join the combustion box, the fan compartment, and the cooking space in fluid communication; providing a fan in the fan compartment; providing a gas burner in a front portion of the combustion box; igniting the burner and heating air in the combustion box; and employing the fan to draw heated air directly from the gas burner in the combustion box through the flue spout, and blowing the heated air horizontally into the cooking space.

Alternatively, the method may include providing fluid communication between the cooking space and the fan compartment with intake holes, and using the fan to draw air from the cooking space into the fan compartment and mixing the cooking space air with the combustion box air.

In another embodiment, the method includes providing fluid communication between the cooking space and the fan compartment with intake holes in a wall of the fan compartment, and using the fan to draw air from the cooking space into the fan compartment and mixing the cooking space air with the combustion box air, and blowing the mixed air horizontally into the cooking space.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the present invention herein disclosed. These and other embodiments of the present invention will become readily apparent to those skilled in the art from the following detailed description of the preferred embodiments having reference to the attached figures; the invention not being limited to any particular preferred embodiment(s) disclosed.

BRIEF DESCRIPTION OF DRAWINGS

Having thus summarized the general nature of the invention, certain preferred embodiments and modifications thereof will become apparent to those skilled in the art from the detailed description herein having reference to the figures that follow, of which.

DETAILED DESCRIPTION

Figure 1:
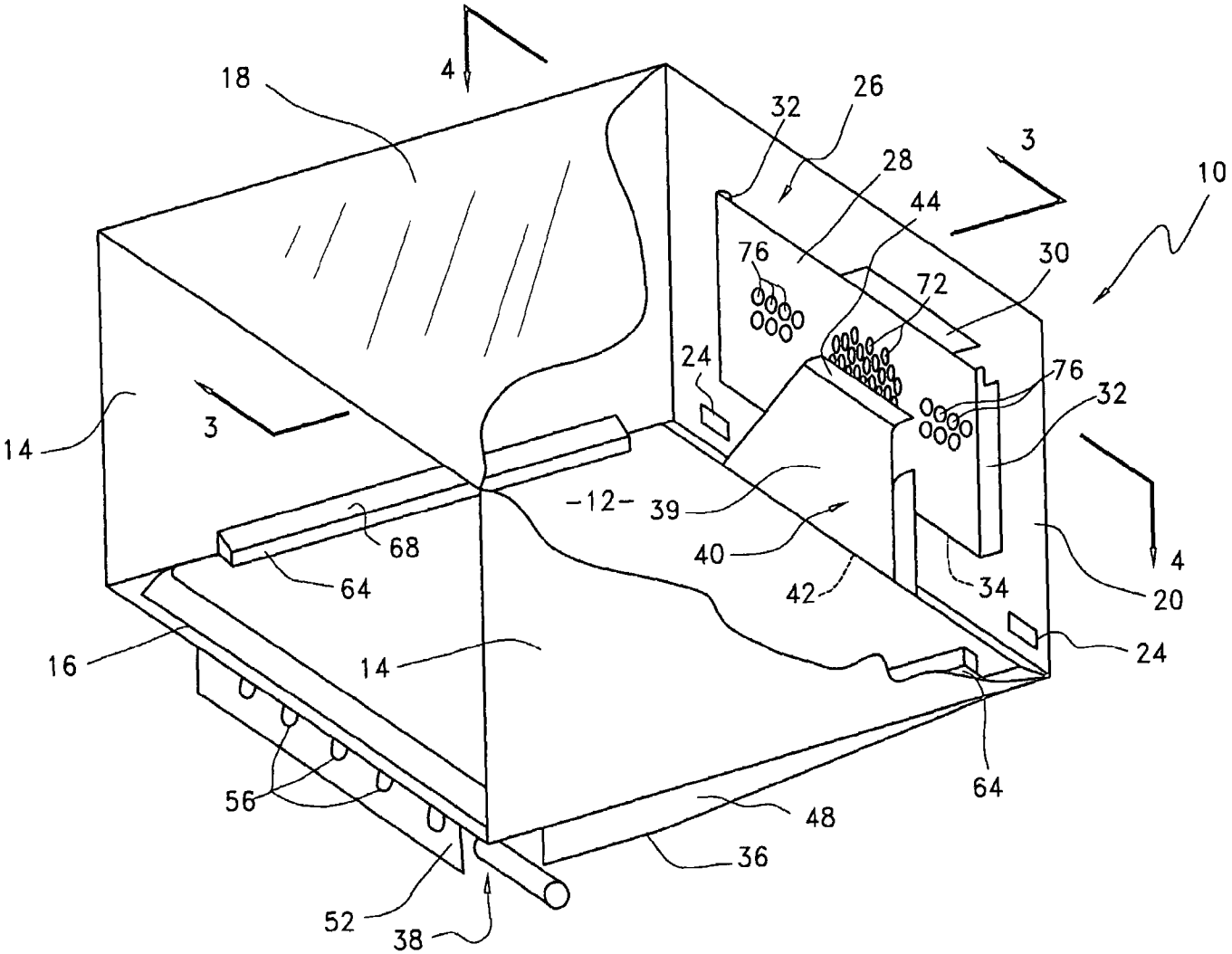
FIG. 1 is an orthogonal view of an oven having preferred features and advantages.

A gas 'true' convection bake oven having preferred features and advantages is shown in FIGS. 1-4. Specifically, an oven 10 is shown comprising an oven cavity 12 defined by two upright side walls 14, a bottom wall 16, a top wall 18, a back wall 20, and a door 22. The back wall 20 of the oven 10 preferably includes one or more exhaust vents 24. At the rear of the oven cavity 12 and adjacent the back wall 20, is preferably a fan compartment 26 defined by a baffle plate 28, and top 30, side 32, and bottom 34 flanges. A combustion box 36 is disposed below the oven bottom wall 16, and includes a gas burner 38. Disposed between the baffle plate 28 and the oven cavity 12 is preferably a flue spout 40. The lower end 42 of the flue spout 40 is in fluid communication with the combustion box 36, and the upper end 44 of the flue spout 40 preferably covers a portion of the baffle plate 28. The open space within the oven cavity provides a cooking space into which can be placed a food product to be cooked by gas "true" convection as described below.

As mentioned above, and as best seen in FIGS. 2 & 3, the combustion box 36 contains a tube-type gas burner 38. As seen best in FIG. 2, the burner 38 preferably extends substantially across the front of the combustion box 36 such that the longitudinal axis of the burner is substantially parallel to the longitudinal axis of the combustion box front wall 52. The combustion box 36 includes two side walls 48, a back wall 50, a front wall 52, and a bottom 54. The front wall 52 of the combustion box 36 is preferably substantially rectangular, and includes primary air intake holes 56. The bottom 54 of the combustion box 36 is preferably substantially sloped upward from front to rear (see FIG. 3). The combustion box bottom 54 may also comprise secondary air inlet holes 58 substantially near the back wall 50 of the box 36. The combustion box 36 may additionally include primary air intake holes 60 immediately below the burner 38. The box 36 is preferably sized and positioned such that the burner 38, disposed in the front of the box 36, is substantially close to the front of the oven 10, thus providing a substantial horizontal distance between the burner 38 and the intake portion 42 of the flue spout 40. The box 36 is also preferably sized such that the burner 38 is a substantial vertical distance below the oven bottom wall 16. The specific advantages of this geometry will be discussed below. Air inlet holes 60 and 56 are preferably sized to allow a sufficient volume of air to enter the combustion box to allow for complete combustion. Inlet holes 60 and 56 are generally sized to allow a sufficient amount of air to enter for the particular burner to be used. The size of the inlet holes is generally dependent on such factors as the total BTU rating of the burner, the particular fuel type, and oven cavity size.

Figure 2:
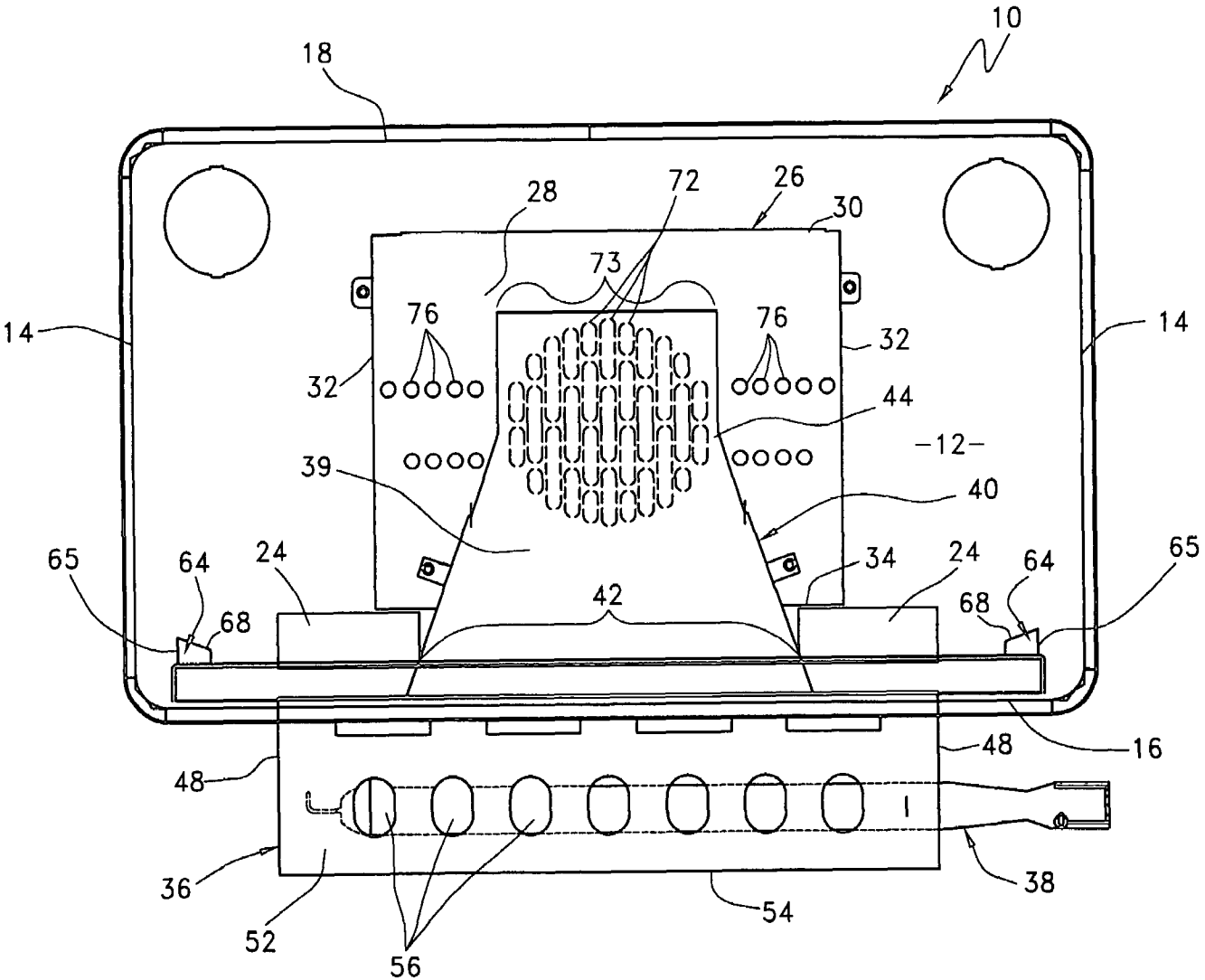
FIG. 2 is a front view of the oven of FIG. 1.
Figure 3:
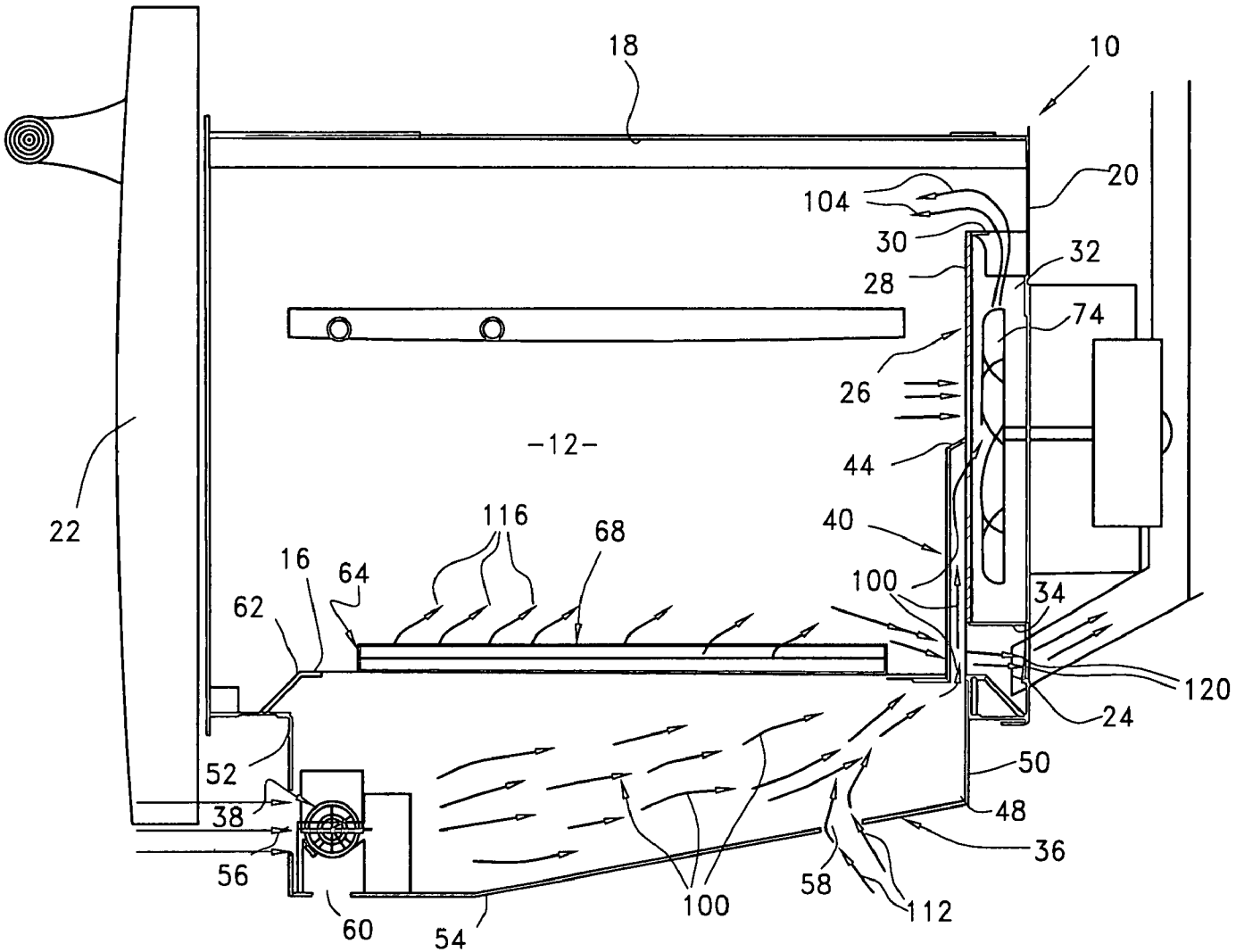
FIG. 3 is a side section view of the oven of FIG. 1, showing a preferred flow pattern.

With reference to FIG. 3, the oven bottom wall 16 preferably includes a thin-walled raised portion 62 in fluid communication with the combustion box 36. In one embodiment, the oven bottom wall 16 includes longitudinal openings 64 extending parallel to the oven side walls 14, and in fluid communication with the combustion box 36. The openings preferably comprise longitudinal elliptical or rectangular holes in the oven bottom wall 16 covered by long raised manifolds 68. Alternatively, the openings 64 may comprise a plurality of circular, elliptical, or rectangular holes in the oven bottom wall 16. The manifolds 68, if present preferably comprise a top and a back (see FIG. 2), and are preferably open on the edge nearest the oven side walls 14. The openings 64 provide the advantage of allowing the oven to be operated in both fan-off and fan-on conditions.

Those skilled in the art will understand how to build a suitable tube-type gas burner 38 for use in an oven having preferred features and advantages. A suitable burner 38 is preferably capable of being used in a typical non-convective bake mode in addition to the 'true' convection mode as discussed herein. The burner 38 preferably has gas outlet holes 70 substantially on the top and rear sides of the tube 38. The burner 38 is preferably ignited by a hot surface ignitor, but may alternatively be ignited by an electric spark ignition or pilot flame, or other ignition method known to those skilled in the art.

With reference to FIGS. 1 & 2, a fan compartment is preferably disposed adjacent to the back wall 20, centered relative to the side walls 14, and may be centered relative to the oven top 18 and bottom wall 16. The baffle plate 28 defines the front of the fan compartment 26. Attached to the baffle plate 28, and extending rearward, are preferably side 32, bottom 34, and top 30 flanges. The flanges may cover substantially all, or only a portion of the space between the baffle plate edges, and the back wall. For example, FIG. 1 shows the fan compartment top flange 30 having an open section, through which heated air and flue products may flow. The flanges 30, 32, 34 are preferably formed as a unitary piece of material with the baffle plate 28, however they may alternatively be welded or otherwise attached. The flanges 30, 32, 34 are preferably attached to the back wall 20 by rivets, bolts, screws, welds, or other appropriate fasteners. As best seen in FIG. 2, the baffle plate 28 preferably comprises a plurality of openings 72 situated substantially at its center (which is preferably located substantially at the center of the centrifugal fan 74, FIG. 3). The openings 72 at the center of the baffle plate 28 define a fan inlet 72. Located peripherally in the baffle plate 28, are preferably a series of holes defining fan outlets 76. The flanges 30, 32, 34 of the fan compartment may also comprise openings forming further fan outlets.

As seen best in FIG. 2, the solid front wall 39 of the flue spout 40 preferably comprises a substantially trapezoidal shape, such that the upper end 44 is preferably about the width of the total fan inlet 73, and the lower end 42 is substantially wider than the upper end 44. The bottom 42 of the flue spout 40 preferably forms an opening which extends substantially across the entire width of the bottom of the flue spout 40 such that the flue spout 40 is in fluid communication with the combustion box 36. The solid front wall 39 of the flue spout 40 is preferably positioned substantially upright and spaced forwardly from the baffle plate 28, and has a plurality of flanges extending rearward toward the baffle plate 28 which define flue spout sides. The upper portion 44 of the flue spout 40 is preferably adapted to cover a substantial portion of the fan inlet 72. For example, the flue spout 40 may be adapted to cover substantially half of the fan inlet 72, or alternatively, as shown in FIG. 2, the flue spout 40 may be sized and disposed such that it covers substantially the entire fan inlet portion 72 of the baffle plate 28. In still another embodiment, the flue spout 40 may cover less than half of the fan inlet portion 72 of the baffle plate 28. The flue spout 40 may comprise openings on either side of its upper portion 44 such that oven air may enter and mix with the flue products before entering the fan compartment 26.

Figure 4:
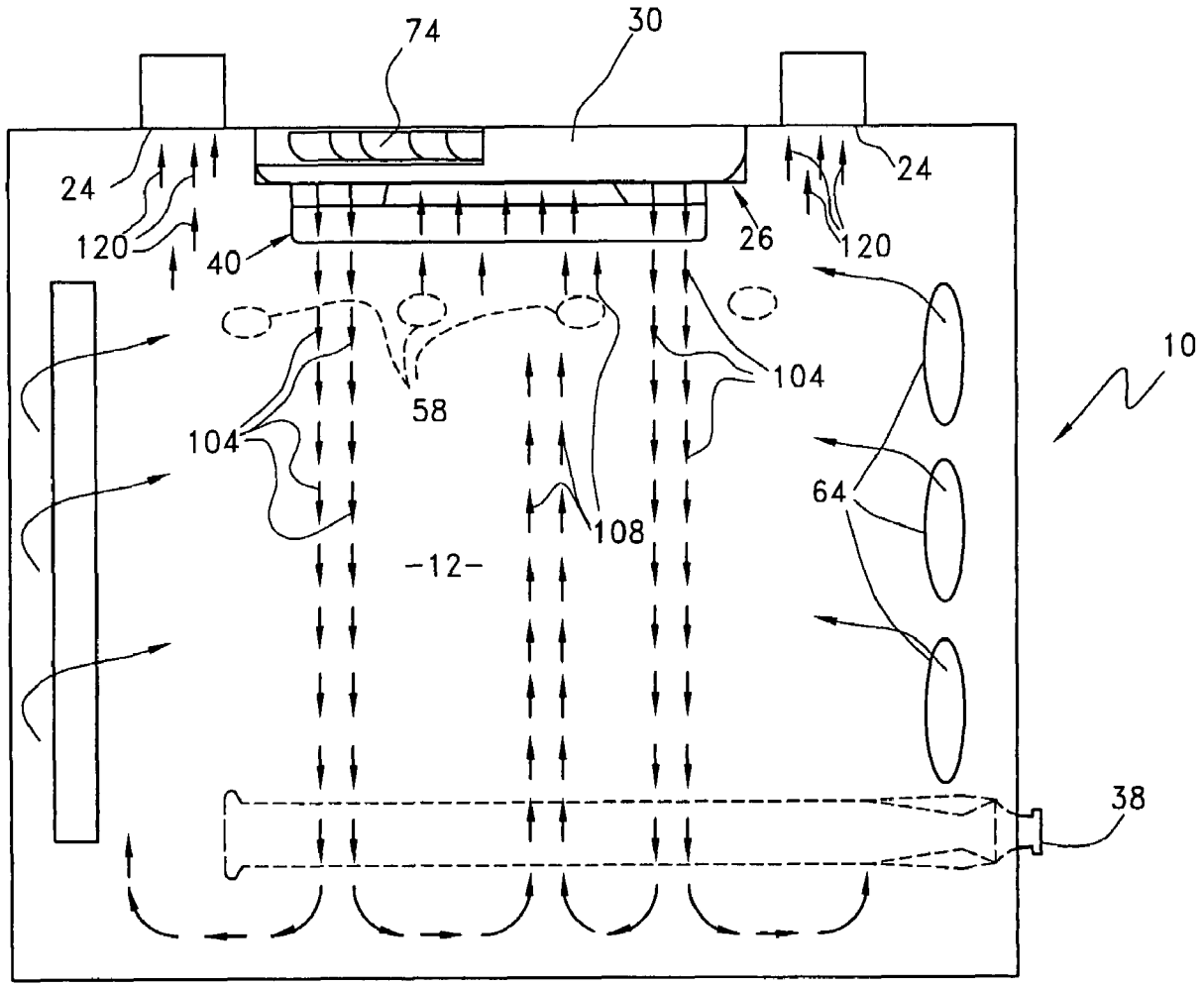
FIG. 4 is a top view of the oven of FIG. 1, showing a preferred flow pattern.

FIGS. 3 and 4 illustrate preferred air flow patterns during operation of the oven 10 in its gas 'true' convection mode. During operation, the burner 38 will be lit, thus heating air and expelling hot flue gasses into the combustion box 36. In gas 'true' convection mode, the fan 74 will pull hot air and flue products from the combustion box 36 into the flue spout intake, up through the flue spout 40, through the fan inlet 72, and into the centrifugal fan 74 as indicated by arrows 100 in FIG. 3. The centrifugal fan 74 will then push the air out through the fan outlets 76 as shown by arrows 104. In the embodiment of FIG. 3, the fan compartment 26 comprises a fan outlet formed in its top flange 30, and the embodiment of FIG. 4 shows flow patterns through fan outlets formed in the baffle plate 28. Those skilled in the art will recognize that the horizontal (rear-to-front in the embodiments shown) movement of air through the oven cavity 12 has the advantage of providing even heating to food products on multiple, vertically displaced trays, whereas a vertically upward or downward flow of air would only effectively heat a single lower or upper tray respectively. If the flue spout 40 covers less than the entire fan inlet 72, (as is the case in FIG. 1), the heated air from the oven cavity 12 will re-enter the fan 74 through the uncovered portion of the fan inlet 72, and be re-circulated through the fan 74 and back into the oven cavity 12 as indicated by arrows 108 in FIG. 4.

Alternatively, if the entire fan inlet 72 is covered by the flue spout 40, thus disallowing the re-circulation of the oven cavity air, only the heated flue products and secondary air will be blown into the oven cavity 12. As mentioned above, the combustion box 36 preferably has secondary air inlet holes 58 in its bottom 54, located toward the rear of the oven. Thus, as indicated by arrows 112, secondary air will be pulled in through these holes 58 and will mix with the hot flue products, thus alleviating the effect on the burner 38 of the increased suction pressure in the combustion box 36.

In another embodiment, the bottom of the oven includes openings 64 in fluid communication with the combustion box 36. According to this embodiment, hot air and flue products will flow out of the combustion box 36, as illustrated by arrows 116 and into the oven cavity. Air entering the center of the oven-cavity 12 from the fan 74, will circulate throughout the oven cavity before exiting through the outlet vents 24.

Those skilled in the art will recognize that the above-described exemplary flow patterns represent only some of the possible flow patterns achievable with an oven 10 as shown and described herein. The amount of flow through the openings 64 in the oven bottom 16 may vary depending on the flow rate of the air being moved by the fan 74, the presence of additional inlet holes, and the specific size of the openings 64 themselves. Those skilled in the art will recognize the various advantages of such arrangements.

In all of the above embodiments, air will be vented out of the oven cavity 12 (shown by arrows 120). By providing exhaust vents 24 at the bottom of the back wall 20, the desired hotter air will preferably remain in the oven cavity 12 while the cooler air, closer to the bottom of the oven cavity 12 will be vented out to the atmosphere and therefore improving heat transfer efficiency. Of course, those skilled in the art will recognize that the exhaust vents may be located toward the top of the back wall 20, or any other appropriate location.

An oven having features described herein will, for example, provide the following advantages. The orientation and remote location of the burner 38 relative to the flue spout intake allows the hot air and flue products to be drawn out of the combustion box 36 without significantly affecting the burner ignition or continued efficient combustion. At the same time, the illustrated arrangement provides desirable heating in a fan-off baking mode. The secondary air inlet holes 58 further contribute to the completeness of combustion.

As mentioned above, an oven having preferred features and advantages may also be used in a standard non-convective bake mode. In this standard bake mode, the fan 74 remains off, and all air flow will be driven by buoyancy and thermally-induced pressure gradients. The heat produced by the burner 38 will heat the air in the combustion box, and will be conducted through the thin-walled oven bottom wall 16. The hot air and flue products in the combustion box 36 will create substantially uniform heating of the oven bottom wall 16. Hot air and flue products will flow up through the openings 64, through the manifolds 68 and into the oven cavity 12, and eventually out through the exhaust vents 24. Additionally, a portion of the hot air and flue products will rise up through the flue spout 40, into the oven compartment 12, and out through the exhaust vents 24.

Thus the oven 10 as described herein is capable of being operated in standard bake mode (i.e. with convection fan off) in which heat and flue gasses from the burner are transferred up through the openings 64 in the oven bottom and into the oven cavity 12; or in a gas 'true' convection bake mode in which hot flue products created by the burner 38 are drawn from the combustion box 36, and are blown into and throughout the oven cavity 12 by a centrifugal convection fan 74. Thus a gas 'true convection' environment is created by an oven as described herein due to the increased temperature of the air being blown into the oven cavity relative to the temperature of the air previously within the oven cavity.

Although certain preferred embodiments and examples have been described herein, it will be understood by those skilled in the art that the present inventive subject matter extends beyond the specifically disclosed embodiments to other alternative embodiments and/or uses of the invention and obvious modifications and equivalents thereof. Thus, it is intended that the scope of the present inventive subject matter herein disclosed should not be limited by the particular disclosed embodiments described above, but should be determined only by a fair reading of the claims that follow.

What is claimed is:

1. An oven comprising:

an oven cavity;

a fan compartment adjacent a wall of the oven cavity and housing a fan therein;

a combustion box located below the fan compartment and at least a portion of a wall separating the combustion box from the oven cavity not being insulated;

a tube-type gas burner located adjacent and parallel to a front wall of the combustion box, the front wall of the combustion box being proximate a front of the oven cavity;

a flue spout configured to provide fluid communication between the combustion box and an inlet portion of the fan compartment.

2. The oven of claim 1, wherein a portion of the inlet portion is open to the oven cavity.

3. The oven of claim 1, further comprising openings formed in a bottom wall of the oven separating the oven cavity from the combustion box.

4. The oven of claim 1, wherein a bottom wall of the combustion box comprises a rearward upward slope.

5. The oven of claim 1, wherein the combustion box comprises a plurality of air inlet holes.

6. The oven of claim 1, wherein the flue spout covers substantially the entire inlet portion of the fan compartment.

7. The oven of claim 1, wherein the flue spout covers at least half of the inlet portion of the fan compartment.

8. A multiple mode oven comprising an oven cavity and a combustion box, the oven cavity comprising an oven bottom wall, the combustion box being positioned under the oven bottom wall, a gas burner disposed within the combustion box, the oven cavity also comprising an oven back wall, a fan compartment being positioned substantially at a center of the back wall, a fan being positioned in the fan compartment, the fan compartment being defined in part by a baffle plate, the baffle plate defining a fan inlet, a flue spout positioned between the oven cavity and the fan compartment, and openings being formed in the oven bottom wall such that the oven cavity and the combustion box are in direct fluid communication.

9. The multiple mode oven of claim 8, wherein the fan inlet is positioned centrally in the baffle plate.

10. The multiple mode oven of claim 8, wherein a portion of the oven back wall forms a portion of the fan compartment.

11. The multiple mode oven of claim 8, wherein the fan compartment comprises multiple peripheral fan outlets.

12. The multiple mode oven of claim 8, wherein the fan comprises a centrifugal fan.

13. The multiple mode oven of claim 8, wherein the gas burner comprises a tube-type gas burner.

14. The multiple mode oven of claim 13, wherein the tube-type gas burner comprises a longitudinal axis and the longitudinal axis extends generally parallel to the oven back wall.

15. The multiple mode oven of claim 8, wherein the combustion box comprises a bottom wall having a portion that slopes upward in a rearward direction

16. The multiple mode oven of claim 8, wherein the combustion box comprises a plurality of primary combustion holes.

17. The multiple mode oven of claim 16, wherein the primary combustion holes are positioned in a front side of the combustion box.

18. The multiple mode oven of claim 16, wherein the combustion box further comprises a plurality of secondary combustion holes.

19. The multiple mode oven of claim 18, wherein the secondary combustion holes are located in a bottom of the combustion box.

20. The multiple mode oven of claim 8, wherein the flue spout comprises an upper portion that covers substantially the entire fan inlet.

21. The multiple mode oven of claim 8, wherein the flue spout comprises an upper portion that covers substantially half of the fan inlet.

22. The multiple mode oven of claim 8, wherein the combustion box is positioned substantially centrally under the oven bottom wall.

23. The multiple mode oven of claim 8, wherein the flue spout comprises a solid front wall.

24. The multiple mode oven of claim 8, wherein the oven cavity comprises at least one exhaust vent located near a bottom of the oven back wall.

25. The multiple mode oven of claim 8, wherein the oven cavity does not comprise a fan compartment attached to a top wall.

26. The multiple mode oven of claim 8, wherein the combustion box comprises primary air intake holes positioned below the gas burner.

27. The multiple mode oven of claim 8, wherein the gas burner is positioned proximate a front of the multiple mode oven.

28. The multiple mode oven of claim 8, wherein the openings in the oven bottom wall are generally covered by manifolds.

29. The multiple mode oven of claim 28, wherein the manifolds comprise a top and a back.

30. The multiple mode oven of claim 28, wherein the manifolds are open toward side walls of the oven cavity.

31. The multiple mode oven of claim 8, wherein the openings in the oven bottom wall comprises a plurality of holes having shapes selected from the group consisting of circles, ellipses and rectangles.

32. The multiple mode oven of claim 8 wherein the fan compartment is generally vertically centered on the oven back wall.

33. The multiple mode oven of claim 8, wherein the fan compartment is generally horizontally centered on the oven back wall.

34. The multiple mode oven of claim 8, wherein the baffle plate comprises a plurality of openings positioned to generally correspond to a center of the fan positioned in the fan compartment.

35. The multiple mode oven of claim 8, wherein the baffle plate comprises a plurality of openings positioned in a central portion of the baffle plate.

36. The multiple mode oven of claim 35, wherein the openings generally correspond to the fan positioned in the fan compartment.

37. The multiple mode oven of claim 8, wherein the combustion box comprises at least one secondary air inlet hole positioned between the gas burner and the flue spout.

38. The multiple mode oven of claim 8, wherein the oven cavity comprises at least one oven vent opening.

39. The multiple mode oven of claim 38, wherein the oven vent opening extends through the back wall.

40. The multiple mode oven of claim 38, wherein the oven vent opening extends through an upper portion of the back wall.

* * * * *

UNITED STATES PATENT AND TRADEMARK OFFICE

CERTIFICATE OF CORRECTION

PATENT NO. : 7,422,009 B2
APPLICATION NO. : 10/824766
DATED : September 9, 2008
INVENTOR(S) : Randy L. Rummel and Eric H. Y. Deng It is certified that error appears in the above-identified patent and that said Letters Patent is hereby corrected as shown below:

Column 3, line 20, please change “Such” to --such--.

Column 4, line 3, please change “figures;” to --figures,--.

Column 6, line 63, please change “12 (shown by arrows 120).” to --12 through the exhaust vents 24 located toward the bottom of the rear wall 20 of the oven 16 (shown by arrows 120).--.

Column 8, claim 41, in Claim 15, change “direction” to --direction.--.

Signed and Sealed this

Fourteenth Day of April, 2009

John Doll

JOHN DOLL
*Acting Director of the United States Patent and Trademark Office*